US008915455B2

(12) United States Patent
Zhou et al.

(10) Patent No.: US 8,915,455 B2
(45) Date of Patent: Dec. 23, 2014

(54) MASSAGE SHOWER THAT CAN ACHIEVE THE DYNAMIC SWITCH OF THE WATER FLOW

(75) Inventors: Huasong Zhou, Xiamen (CN); Ziguang Liu, Xiamen (CN); Jianmin Chen, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 345 days.

(21) Appl. No.: 13/496,452

(22) PCT Filed: Dec. 21, 2010

(86) PCT No.: PCT/CN2010/080041
§ 371 (c)(1),
(2), (4) Date: Mar. 15, 2012

(87) PCT Pub. No.: WO2011/076101
PCT Pub. Date: Jun. 30, 2011

(65) Prior Publication Data

US 2012/0181353 A1 Jul. 19, 2012

(30) Foreign Application Priority Data

Dec. 25, 2009 (CN) ..... 2009 1 0261793
Dec. 25, 2009 (CN) ..... 2009 2 0353587 U

(51) Int. Cl.

| | |
|---|---|
| ***A62C 31/00*** | (2006.01) |
| ***B05B 1/08*** | (2006.01) |
| ***B05B 3/04*** | (2006.01) |
| ***A61H 9/00*** | (2006.01) |
| ***B05B 1/18*** | (2006.01) |

(52) U.S. Cl.
CPC ..... *B05B 3/04* (2013.01); *A61H 9/0021* (2013.01); *B05B 1/18* (2013.01)
USPC ..... 239/446; 239/101; 239/381; 239/383; 239/443; 239/525

(58) Field of Classification Search
USPC ..... 239/101, 380, 381, 382, 383, 443, 446, 239/99, 525
See application file for complete search history.

(56) References Cited

U.S. PATENT DOCUMENTS

| | | | | |
|---|---|---|---|---|
| 5,397,064 | A | 3/1995 | Heitzman | |
| 5,862,985 | A | 1/1999 | Neibrook et al. | |
| 6,412,711 | B1 | 7/2002 | Fan | |
| 7,114,666 | B2 * | 10/2006 | Luettgen et al. | 239/381 |
| 2007/0056090 | A1 | 3/2007 | Zhou | |

FOREIGN PATENT DOCUMENTS

| | | | |
|---|---|---|---|
| CN | 2843623 | Y | 12/2006 |
| CN | 1891347 | A | 1/2007 |

(Continued)

*Primary Examiner* — Steven J Ganey
(74) *Attorney, Agent, or Firm* — Rabin & Berdo, P.C.

(57) ABSTRACT

The present invention discloses a massage shower that can achieve the dynamic switch of the water flow, it comprises a hollow essential body, a oblique water body, a impeller that is under the said oblique water body, a face cover component that has the effluent holes and a moving plate used to switch the effluent holes of different areas in the face cover component, the said impeller and the said moving plate are connected through a differential gearing transmission retarding mechanism. The said massage shower can achieve the dynamic switch of different effluent holes on the face cover of the shower during the using process, and achieve excellent massage effect.

13 Claims, 7 Drawing Sheets

(56) References Cited

FOREIGN PATENT DOCUMENTS

| | | | |
|---|---|---|---|
| CN | 101020165 | A | 8/2007 |
| CN | 200942366 | Y | 9/2007 |
| CN | 101585022 | A | 11/2009 |
| CN | 201361594 | Y | 12/2009 |
| CN | 10 1773880 | A | 7/2010 |
| CN | 201572694 | U | 9/2010 |

* cited by examiner

MASSAGE SHOWER THAT CAN ACHIEVE THE DYNAMIC SWITCH OF THE WATER FLOW

FIELD OF THE INVENTION

The present invention relates to a massage shower, more particularly to a massage shower that can achieve the dynamic switch of the water flow.

BACKGROUND OF THE INVENTION

To get good massage effect, the massage shower is not only needed to form pressure water column, but also need to achieve the dynamic switch of the pressure water column. Thereby, CN101020165A discloses a massage shower that can achieve the dynamic switch of the pressure water column, it at least comprises a essential body, a oblique water body, a impeller, a massage dish and a face cover, the essential body has a grip, a water inlet and a water outlet, the oblique water body, the impeller, the massage dish and the face cover is assembled in sequence at the water outlet of the essential body; a oblique water hole is opened on the oblique water body; the impeller is assembled under the oblique water body, and the blades of the impeller faces to the oblique water hole, a pin-jointed hole is opened at the center of the impeller, the periphery of the pin-jointed hole extends downwards to form eccentric wheel; several massage heads are under the massage disk, the center hole of the massage disk is sleeved around the eccentric wheel of the impeller; through holes are set on the face cover, corresponding to the said massage heads, and the face cover hermetically covers the outlet of the essential body so that the oblique water body, the impeller, the massage disk are limited in the water outlet, the massage head reaches out from the through hole and exposes on the surface of the face cover, the center shaft of the face cover's inside passes through the center hole of the massage disk and is inserted in the pin-jointed hole of the impeller. During the using process, the rotating impeller rotates in the center hole of the massage disk through its eccentric shaft, and drives the massage disk to deflect ahead eccentric direction always, and the massage head does the eject-retract-eject movement repeatedly with respect to the top surface, and the ejected massage head beats the human body to achieve the massage effect. However, the said massage shower just achieve the change of the massage head's action, it cannot control the dynamic water outlet of different massage head; and because the said massage shower does not have retarding mechanism, the usually big water pressure and flow rate make the rotation speed of the impeller fast, so that the rotation frequency of the massage disk driven by the impeller is too fast and it affects the massage effect.

SUMMARY OF THE INVENTION

The object of the present invention is to overcome the defects at the prior art and offer a massage shower that can achieve the dynamic switch of the water flow. The said massage shower can achieve the dynamic switch of different effluent holes on the face cover of the shower during the using process, and achieve excellent massage effect.

The technical proposal of the present invention is:

A massage shower that can achieve the dynamic switch of the water flow, it comprises:

A hollow essential body, which has an entry end and an effluent end;

A water power driver element, it comprises a oblique water body and a impeller that has a center hole under the oblique water body, and the oblique water body is set at the effluent end of the said essential body, several oblique holes that form oblique water flow and drive the impeller to rotate are distributed on the oblique water body;

A moving plate, which has a center hole and at least one water-division hole;

And a face cover component, which comprises an upper cover and a face cover, the upper periphery of the said upper cover is fixed to the periphery of the said oblique water body, and said upper cover and the said oblique water body form a cavity together, and an upper shaft base is set in the center position of the bottom surface of the said oblique water body, and a lower shaft base is set in the center position of the inner bottom surface of the said upper cover, a rotation shaft which passes through the center hole of the impeller and the center hole of the moving plate in sequence from top to bottom is set between the said lower shaft base and the said upper shaft base; there are at least two independent cavities between the upper cover and the face cover, and at least one effluent hole is set on the bottom surface of the upper cover corresponding to each said independent cavity, and the said effluent holes are all set at the position corresponding to the said water-division hole; several water injection nozzles that connect to every independent cavity respectively are distributed on the said face cover;

The said moving plate rotates with respect to the inner bottom surface of the upper cover, so that its water-division hole is connected to different effluent holes or the combination of the effluent holes;

The impeller and the moving plate are connected through a differential gearing transmission retarding mechanism.

In a preferred embodiment, the said differential gearing transmission retarding mechanism comprises a eccentric wheel formed by the downward extending of the hole periphery of the impeller, an external gear with a center hole and a annular gear formed by the surround wall of the upper cover, the external gear is sleeved around the outboard of the said eccentric wheel through its center hole and engaged with the annular gear by small teeth difference.

In a preferred embodiment, the said moving plate is spliced with the said external gear which has at least two circumferentially distributed circular sockets through at least two circumferentially distributed cylinder on the top surface of the moving plate, and the moving plate rotates driven by the external gear.

In a preferred embodiment, several through holes circumferentially distributed are set on the said external gear for water flow.

In a preferred embodiment, the annular groove is formed in each periphery corresponding to each effluent hole on the inner bottom surface of the said upper cover, and the sealing ring is set in each said annular groove to seal the inner bottom surface of the upper cover and the end face of the moving plate.

In a preferred embodiment, two radially distributed effluent holes are set on the inner bottom surface of the upper cover, and a round water-division hole which is longer than or at least equal to ½ circular arc is set on the said moving plate, and two independent cavities are formed between the said face cover and the said upper cover, and each said independent cavity is connected to a said effluent hole respectively.

In a preferred embodiment, the said one independent cavity is sleeved in another said independent cavity.

In a preferred embodiment, the said two independent cavities are right-and-left distributed.

In a preferred embodiment, the length of the said round water-division hole is longer than half of the said moving plate's perimeter, the two effluent holes that is radially distributed on the upper cover and the water-division holes form three states: the connecting of the first effluent hole, the connecting of the second effluent hole and the simultaneous connecting of both the effluent holes.

As noticed, the said water injection nozzles can be replaced with different other form of water effluent to fit different demands.

Unless specially designated, the meaning of all the technical and scientific terms here are same to the meaning that usually understood by the persons skilled in the present art. Likewise, all the publications, patent applications, patents and other references can import the present invention as reference.

The "upper", "lower" in the present invention are subjected to the direction when the shower is used, namely the lower end is the effluent end of the shower, and the upper end is the entry end of the shower.

As known from the said description, the present invention creatively offer a simple structural massage shower that can achieve the dynamic switch of the water flow, and the said impeller and the said moving plate are connected through a differential gearing transmission retarding mechanism in the said massage shower, the water drives the moving plate of the water-division unit to rotate after its speed is reduced by the retarding mechanism, at the moment, the rotating frequency of the moving plate is reduced, and the dynamic switch of different effluent holes on the face cover would be lower, and make the user feel it, achieving excellent massage effect.

DESCRIPTION OF THE PREFERRED EMBODIMENTS

Embodiment 1

Figure 1:
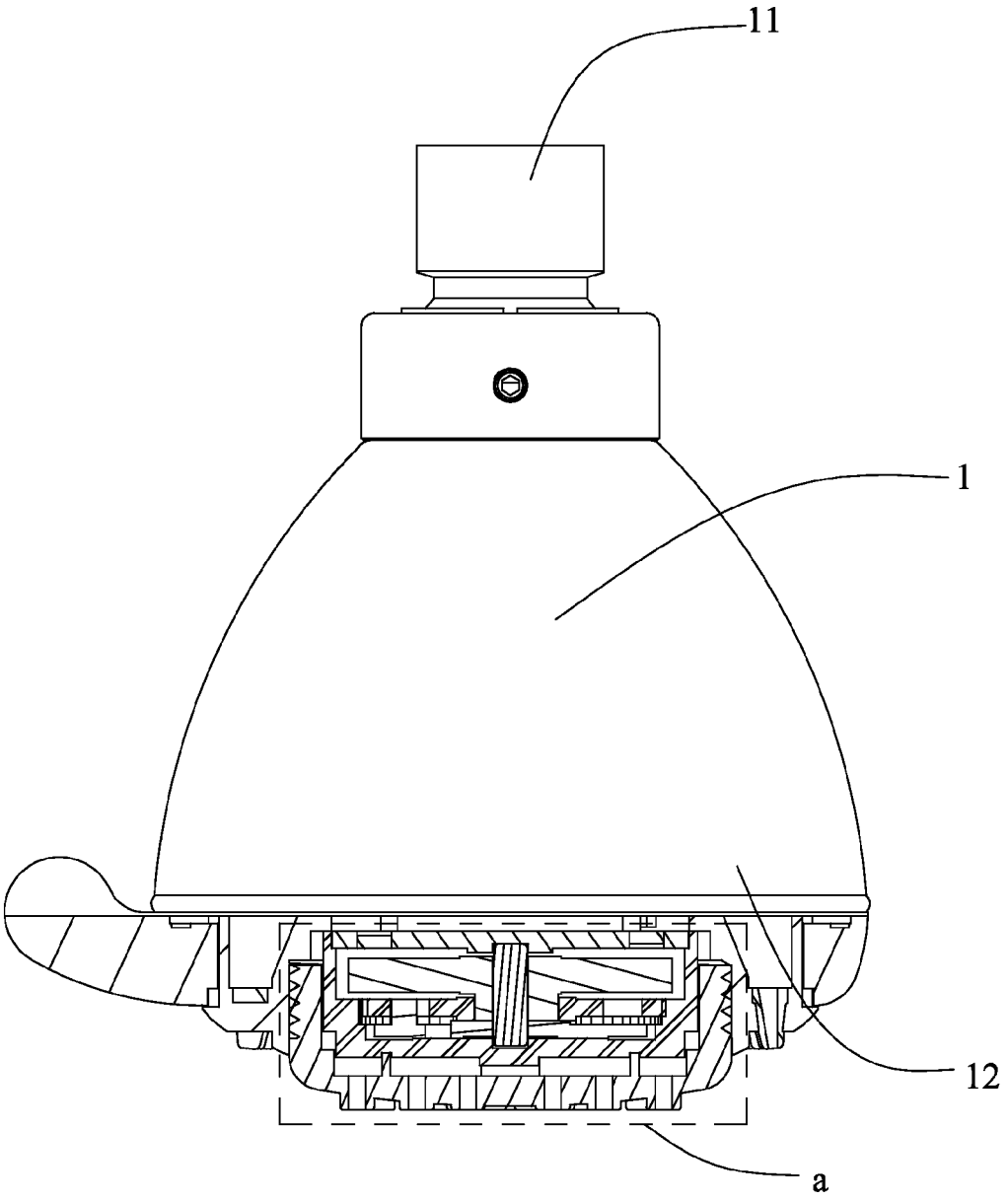
FIG. 1 shows the partly sectional view of the shower in the embodiment.
Figure 2:
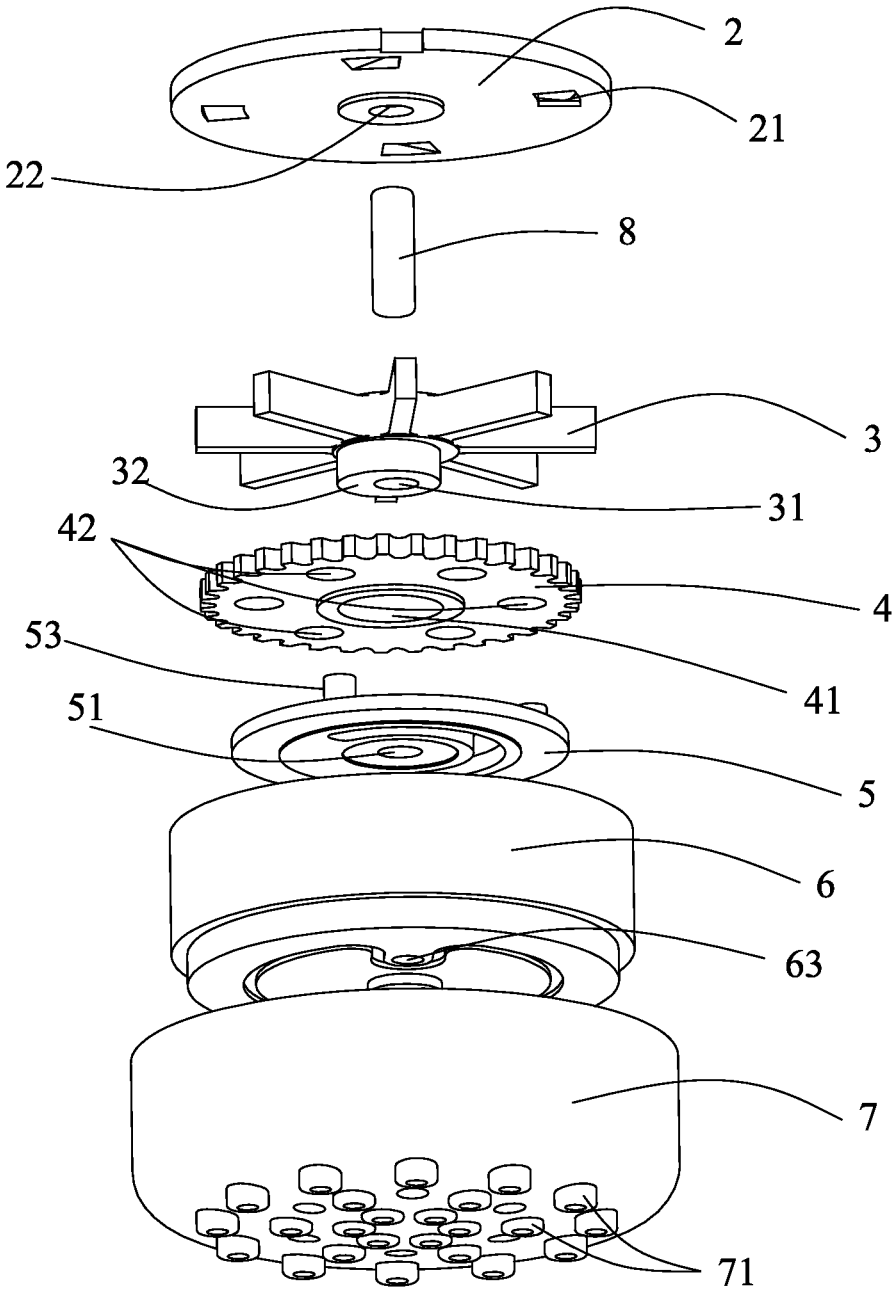
FIG. 2 shows the exploded view of the FIG. 1*a* along one direction.
Figure 3:
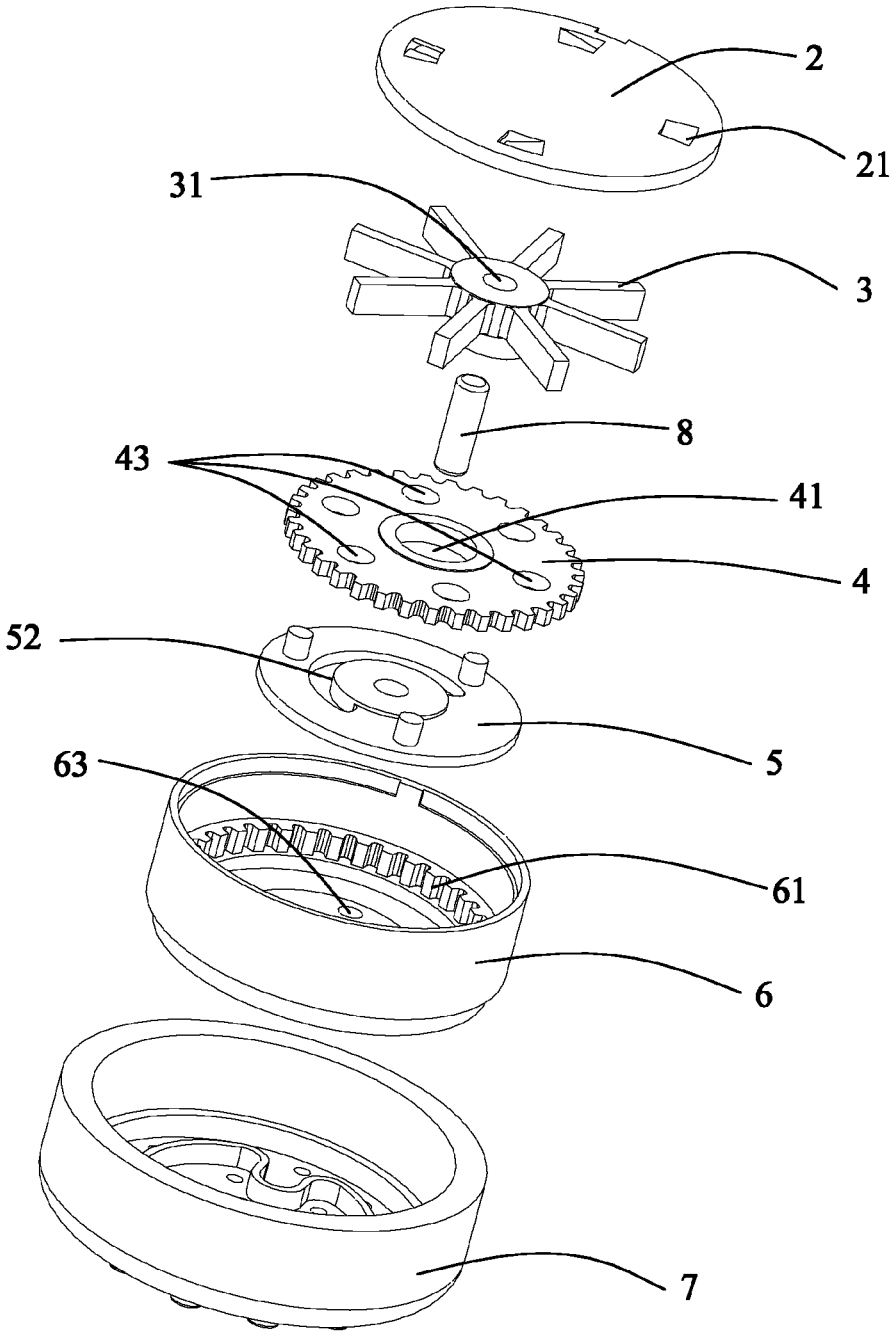
FIG. 3 shows the exploded view of the FIG. 1*a* along another direction.

With the following description of the drawings and specific embodiments, the invention shall be further described in details.

As shown in FIG. 1, FIG. 2, FIG. 3, FIG. 4 and FIG. 5, the massage shower that can achieve the dynamic switch of the water flow comprises a hollow essential body 1 which has an entry end 11 and an effluent end 12.

An oblique water body 2 is fixed at the effluent end 12 of the essential body 1, in which several oblique holes 21 that form oblique water flow are distributed, and of which the bottom surface has an upper shaft base 22.

An impeller 3 that has a center hole 31 is set under the oblique water body 1, the oblique water flow from the oblique hole 21 impacts the blades of the impeller 3 and drives the impeller 3 to rotate; the periphery of the center hole 31 extends downwards to form a eccentric wheel 32.

An external gear 4 that has a center hole 41 is set under the impeller 3, and the external gear 4 is sleeved around the outboard of the eccentric wheel 32 through the center hole 41. Three circular sockets 42 and three through holes 43 that is used for the effluent of the water flow are formed circumferential in the external gear 4.

A moving plate 5 that has a center hole 51 is set under the external gear 4, and a round water-division hole 52 that is over ½ circular arc is set in the moving plate 5, and three cylinders 53 that is spliced with the circular sockets 42 in the external gear 4 are formed circumferential on the top surface of the moving plate 5, so that the moving plate 5 can rotate with the external gear 4.

Figure 4:
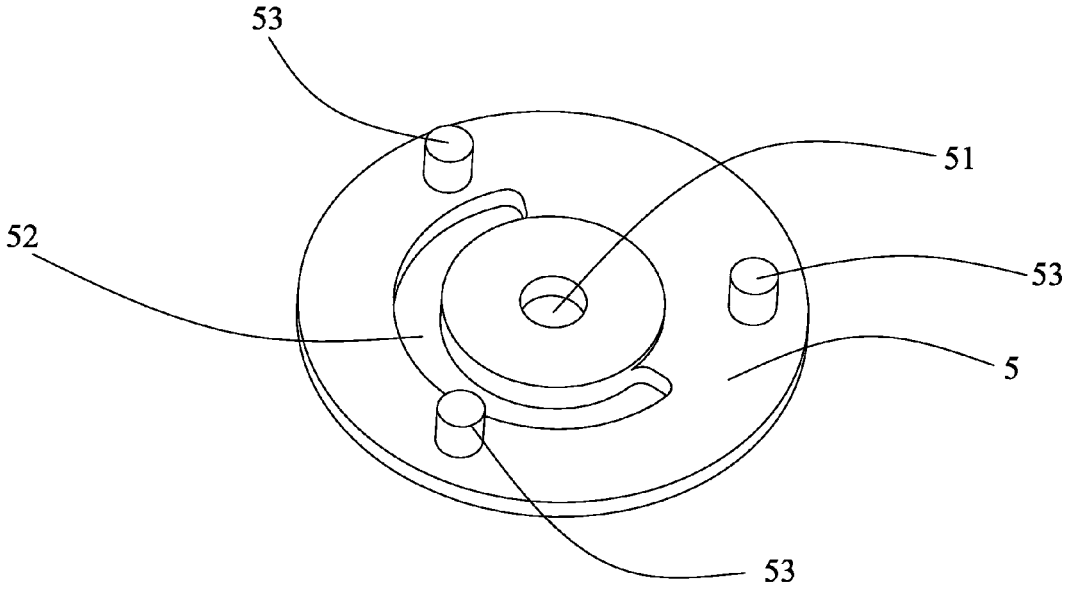
FIG. 4 shows the solid structural profile of the moving plate.
Figure 5:
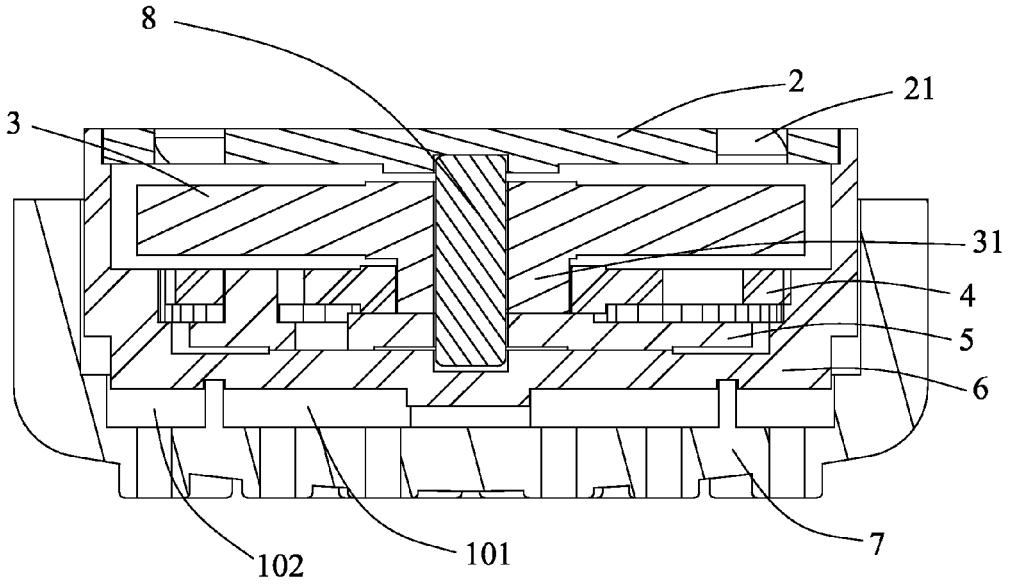
FIG. 5 shows the enlarged view of the FIG. 1*a;*

As shown in FIG. 4, an upper cover 6 is set under the moving plate 5, the upper periphery of the upper cover 6 is welded with the periphery of the oblique water body 2, so that the upper cover 6 and the oblique water body 2 form an independent cavity together, and the impeller 3, the external gear 4 and the moving plate 5 are all set in the independent cavity. An annular gear 61 is form on the inner surround wall of the upper cover 6, and the annular gear 61 meshes the external gear 4 with small teeth difference. A lower shaft base 62 is formed at the center position of the upper cover 6's inner bottom surface, and the upper cover 6 has the effluent hole 63 and the effluent hole 64 which make the lower shaft base 62 as their center and distribute radially (as shown in FIG. 8, FIG. 9, FIG. 10 and FIG. 11), and the effluent holes 63 and 64 are set at the corresponding position to the water-division hole 52; the peripheries of the effluent holes 63 and 64 are the annular groove formation, and each annular groove has a sealing ring that seals the inner bottom surface of the upper cover 6 and the end surface of the moving plate 5.

A rotation shaft 8 is set between the said lower shaft base 62 and the said upper shaft base 22, which passes through the center hole 31 of the impeller 3 and the center hole 51 of the moving plate 5 in sequence from top to bottom to make the impeller 3 and the moving plate 5 rotate around the rotation shaft 8.

A face cover 7 is welded under the upper cover 6, and an independent cavity 101 and an independent cavity 102 are formed between the face cover 7 and the upper cover 6, and the independent cavity 101 and the independent cavity 102 connect the effluent hole 63 and the effluent hole 64 respectively. In the present embodiment, a convex cavity is formed at the center position of the inner bottom surface of the face cover 7, and the said convex cavity sinks inwards at the position corresponding to the effluent hole 63, and a groove that has the same shape of the said convex cavity is formed on the outer bottom surface of the upper cover 6, and the said convex cavity and the said groove are welded and fixed to form the independent cavity 101 (inner ring) that connects the effluent hole 64, and the area besides the said independent cavity and between the upper cover 6 and the face cover 7 forms another independent cavity 102 (outer ring) that connects the effluent hole 63, the independent cavity 101 is sleeved in the independent cavity 102.

Several water injection nozzles that connect the independent cavity 101 and the independent cavity 102 respectively are distributed on the outer bottom surface of the face cover 7.

Figure 6:
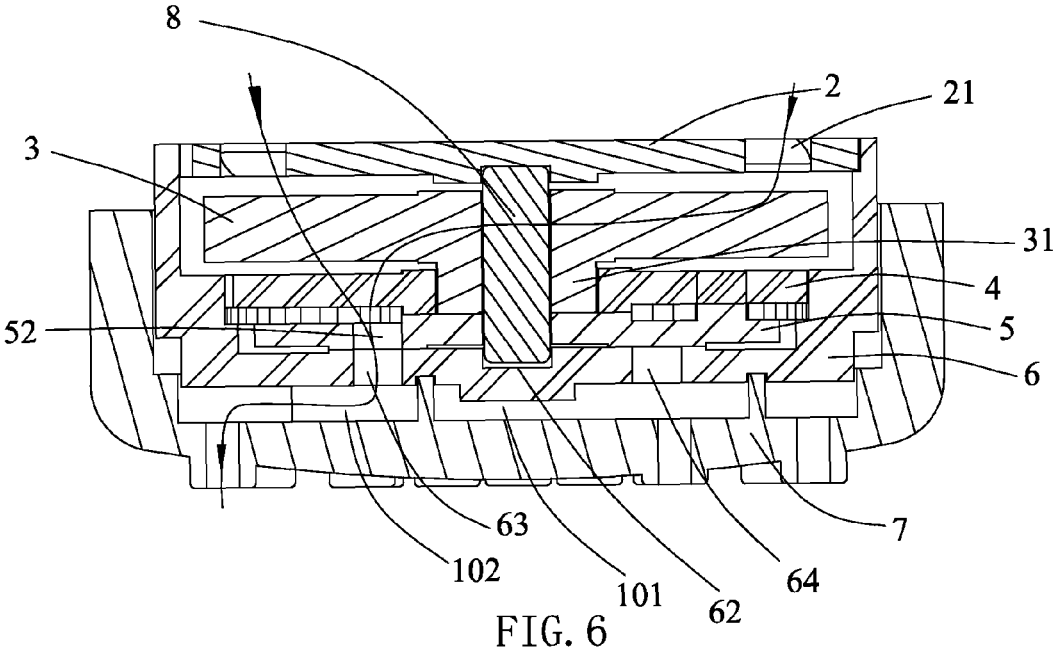
FIG. 6 shows the abridged general view of the water assesses when the water comes from the outer ring of the face cover.
Figure 7:
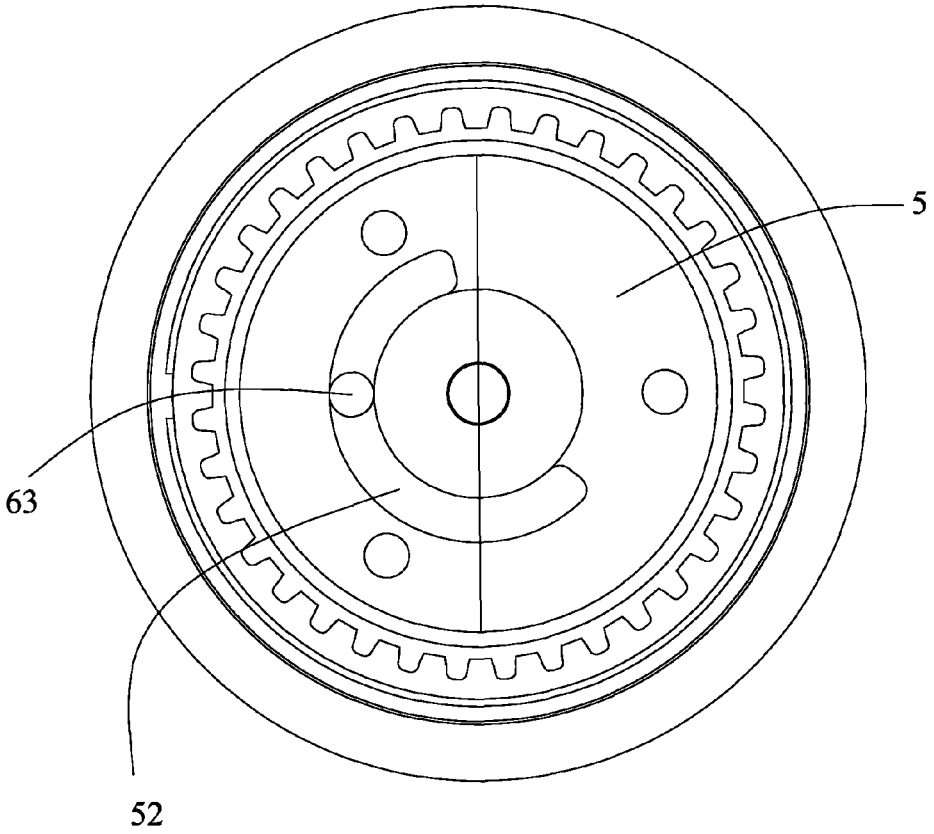
FIG. 7 shows the abridged general view of the positions of the moving plate and the inner bottom surface of the upper cover when the water comes from the outer ring of the face cover.

During the using process, the water flow comes from the oblique holes 21 of the oblique water body 2, and impacts the impeller 3 to make it rotate, and then drives the eccentric wheel 32 under the impeller 3 and the external gear 4 to rotate in the annular gear 61 of the upper cover 6; due to the differential gearing transmission retarding mechanism formed by the eccentric wheel 32, the external gear 4 and the annular gear 61 together, the rotating speed reduces substantially from the impeller 3 to the external gear 4; at this moment, the moving plate 5 rotates with low frequency driven by the external gear 4, and form three waterway state:

1) As shown in FIG. 6 and FIG. 7, the water-division hole 52 rotates to the position corresponding to the effluent hole 63, at this moment, the independent cavity 102 located at the outer ring is connected to the waterway, so that the water comes from the outer ring of the shower but the inner ring of the shower.

Figure 8:
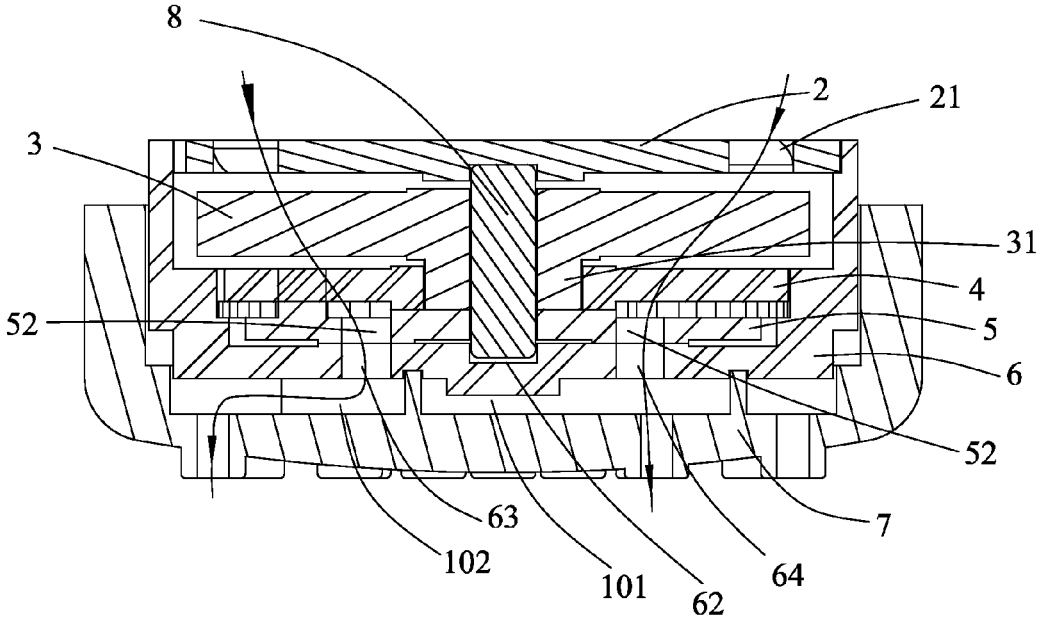
FIG. 8 shows the abridged general view of the water assesses when the water comes from the outer ring and the inner ring of the face cover simultaneously.
Figure 9:
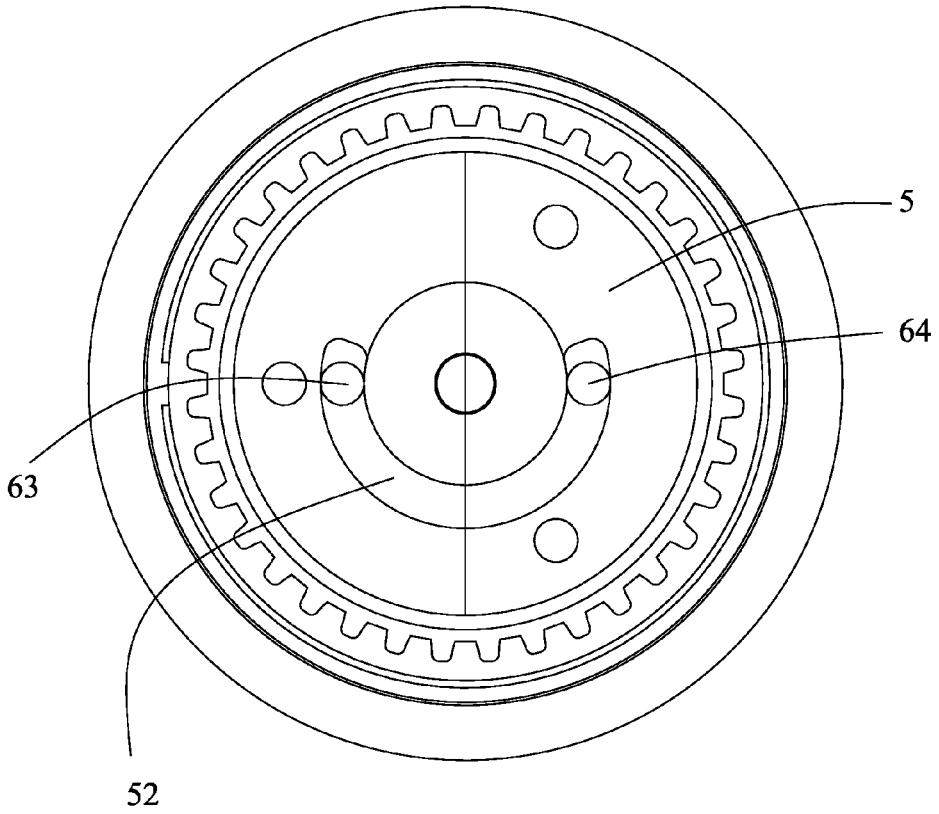
FIG. 9 shows the abridged general view of the positions of the moving plate and the inner bottom surface of the upper cover when the water comes from the outer ring and the inner ring of the face cover simultaneously.

2) As shown in FIG. 8 and FIG. 9, the water-division hole 52 rotates to the position corresponding to the effluent hole 63 and the effluent hole 64, at this moment, the independent cavity 102 located at the outer ring and the independent cavity 101 located at the inner ring are all connected to the waterway, so that the water comes from the outer ring of the shower and the inner ring of the shower simultaneously.

Figure 10:
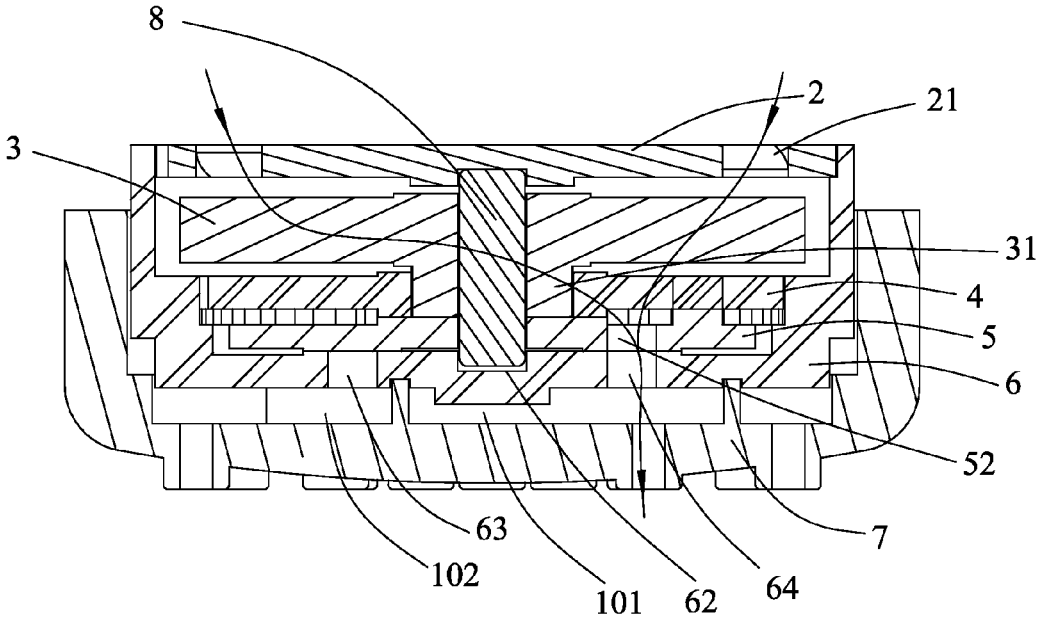
FIG. 10 shows the abridged general view of the water assesses when the water comes from the inner ring of the face cover.
Figure 11:
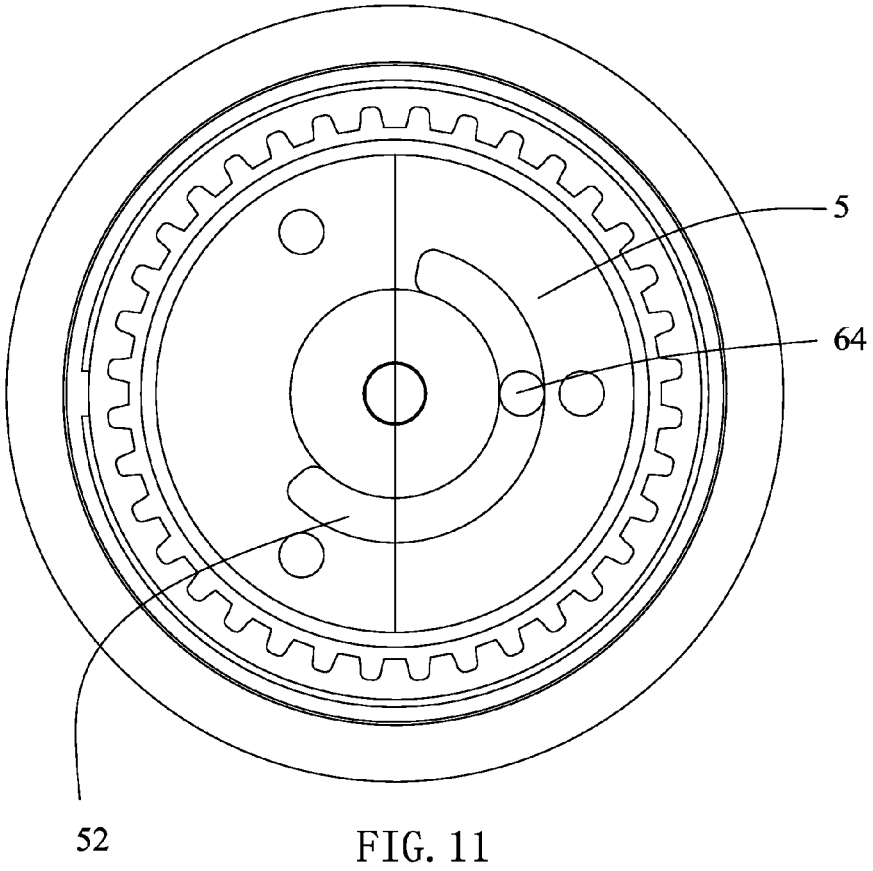
FIG. 11 shows the abridged general view of the positions of the moving plate and the inner bottom surface of the upper cover when the water comes from the inner ring of the face cover.

3) As shown in FIG. 10 and FIG. 11, the water-division hole 52 rotates to the position corresponding to the effluent hole 64, at this moment, the independent cavity 101 located at the inner ring is connected to the waterway, so that the water comes from the inner ring of the shower but the outer ring of the shower.

The invention has been described with reference to the preferred embodiment mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The massage shower that can achieve the dynamic switch of the water flow in the present invention offers a massage shower that can achieve the dynamic switch of the water flow with simple structure, the dynamic switch of different effluent holes on the face cover would be lower, and makes the user feel it, achieving excellent massage effect, so the present invention has good industrial applicability.

What is claimed is:

1. A massage shower that can achieve the dynamic switch of the water flow, wherein it comprises:

a hollow essential body, which has an entry end and an effluent end;

a water power driver element, it comprises a oblique water body and a impeller that has a center hole under the oblique water body, and the oblique water body is set at the effluent end of the said essential body, several oblique holes that form oblique water flow and drive the impeller to rotate are distributed on the oblique water body;

a moving plate, which has a center hole and at least one water-division hole; and a face cover component, which comprises an upper cover and a face cover, the upper periphery of the said upper cover is fixed to the periphery of the said oblique water body, and said upper cover and the said oblique water body form a cavity together, and an upper shaft base is set in the center position of the bottom surface of the said oblique water body, and a lower shaft base is set in the center position of the inner bottom surface of the said upper cover, a rotation shaft which passes through the center hole of the impeller and the center hole of the moving plate in sequence from top to bottom is set between the said lower shaft base and the said upper shaft base; there are at least two independent cavities between the upper cover and the face cover, and at least one effluent hole is set on the inner bottom surface of the upper cover corresponding to each said independent cavity, and the said effluent holes are all set at the position corresponding to the said water-division hole; several water injection nozzles that connect to every independent cavity respectively are distributed on the said face cover; wherein:

the said moving plate rotates with respect to the inner bottom surface of the upper cover, so that its water-division hole is connected to different effluent holes or the combination of the effluent holes;

the impeller and the moving plate are connected through a differential gearing transmission retarding mechanism; and said differential gearing transmission retarding mechanism comprises a eccentric wheel formed by the downward extending of the hole periphery of the impeller, an external gear with a center hole and a annular gear formed by the surround wall of the upper cover, the external gear is sleeved around the outboard of the said eccentric wheel through its center hole and engaged with the annular gear by small teeth difference.

2. A massage shower that can achieve the dynamic switch of the water flow according to claim 1, wherein said moving plate is spliced with the said external gear which has at least two circumferentially distributed circular sockets through at least two circumferentially distributed cylinder on the top surface of the moving plate, and the moving plate rotates driven by the external gear.

3. A massage shower that can achieve the dynamic switch of the water flow according to claim 2, wherein several through holes circumferentially distributed are set on the said external gear for water flow.

4. A massage shower that can achieve the dynamic switch of the water flow according to claim 3, wherein the annular groove is formed in each periphery corresponding to each effluent hole on the inner bottom surface of the said upper cover, the sealing ring is set in each said annular groove to seal the inner bottom surface of the upper cover and the end face of the moving plate.

5. A massage shower that can achieve the dynamic switch of the water flow according to claim 4, wherein two radially distributed effluent holes are set on the inner bottom surface of the upper cover, and a round water-division hole which is longer than or at least equal to ½ circular arc is set on the said moving plate, and two independent cavities are formed between the said face cover and the said upper cover, and each said independent cavity is connected to a said effluent hole respectively.

6. A massage shower that can achieve the dynamic switch of the water flow according to claim 5, wherein said one independent cavity is sleeved in another said independent cavity.

7. A massage shower that can achieve the dynamic switch of the water flow according to claim 5, wherein said two independent cavities are right-and-left distributed.

8. A massage shower that can achieve the dynamic switch of the water flow according to claim 5, wherein the length of the said round water-division hole is longer than half of the said moving plate's perimeter, the two effluent holes that is radially distributed on the upper cover and the water-division holes form three states: the connecting of the first effluent hole, the connecting of the second effluent hole and the simultaneous connecting of both the effluent holes.

9. A massage shower that can achieve the dynamic switch of the water flow according to claim 1, wherein an annular groove is formed in each periphery corresponding to each effluent hole on the inner bottom surface of the said upper cover, the sealing ring is set in each said annular groove to seal the inner bottom surface of the upper cover and the end face of the moving plate.

10. A massage shower that can achieve the dynamic switch of the water flow according to claim 9, wherein two radially distributed effluent holes are set on the inner bottom surface of the upper cover, and a round water-division hole which is longer than or at least equal to ½ circular arc is set on the said moving plate, and two independent cavities are formed between the said face cover and the said upper cover, and each said independent cavity is connected to a said effluent hole respectively.

11. A massage shower that can achieve the dynamic switch of the water flow according to claim 10, wherein said one independent cavity is sleeved in another said independent cavity.

12. A massage shower that can achieve the dynamic switch of the water flow according to claim 10, wherein said two independent cavities are right-and-left distributed.

13. A massage shower that can achieve the dynamic switch of the water flow according to claim 10, wherein the length of the said round water-division hole is longer than half of the said moving plate's perimeter, the two effluent holes that is radially distributed on the upper cover and the water-division holes form three states: the connecting of the first effluent hole, the connecting of the second effluent hole and the simultaneous connecting of both the effluent holes.

* * * * *